US007967470B2

(12) United States Patent
Chang

(10) Patent No.: US 7,967,470 B2
(45) Date of Patent: Jun. 28, 2011

(54) ILLUMINATING RIBBON

(75) Inventor: Jen-Chi Chang, Caotun Township, Nantou County (TW)

(73) Assignee: Shieng Huong Enterprise Co., Ltd., Caotun Township (TW)

( * ) Notice: Subject to any disclaimer, the term of this patent is extended or adjusted under 35 U.S.C. 154(b) by 354 days.

(21) Appl. No.: 12/379,016

(22) Filed: Feb. 11, 2009

(65) Prior Publication Data

US 2010/0127636 A1 May 27, 2010

(30) Foreign Application Priority Data

Nov. 26, 2008 (TW) ..... 97145765 A

(51) Int. Cl.
*F21S 4/00* (2006.01)

(52) U.S. Cl. ..... 362/249.14; 362/249.16; 362/249.02; 362/630; 362/631; 362/557

(58) Field of Classification Search ..... 362/249.02, 362/249.04, 249.08, 249.14, 249.16, 227, 362/240, 221, 630, 631, 555, 557, 644, 806; 315/294, 297, 312
See application file for complete search history.

(56) References Cited

U.S. PATENT DOCUMENTS

| | | | | |
|---|---|---|---|---|
| 4,994,944 | A * | 2/1991 | Vernondier | 362/239 |
| 5,523,741 | A * | 6/1996 | Cane | 340/573.1 |
| 5,876,109 | A * | 3/1999 | Scalco | 362/104 |
| 6,681,965 | B1 * | 1/2004 | Tran | 223/46 |
| 7,416,467 | B2 * | 8/2008 | Avdellas | 446/297 |
| 2008/0130272 | A1 * | 6/2008 | Waters | 362/106 |

* cited by examiner

*Primary Examiner* — Haissa Philogene
(74) *Attorney, Agent, or Firm* — Bacon & Thomas, PLLC

(57) ABSTRACT

An illuminating ribbon has a decoration ribbon and a flexible circuit board with light-emitting devices. The decoration ribbon has two long sides, in which one of the two long sides has a sewing line. The flexible circuit board with light-emitting devices is disposed on the decoration ribbon and fixed to one long side of the decoration ribbon via the sewing line. The flexible circuit board with light-emitting devices includes an insulator with flexible flat surface; first and second electrical wires; N light-emitting devices; and a power device. The first and second electrical wires are embedded in parallel into the insulator with flexible flat surface. The N light-emitting devices are connected to the first and second electrical wires. The power device is connected to the first and second electrical wires to supply power to the N light-emitting devices and thus to generate light on the decoration ribbon.

10 Claims, 2 Drawing Sheets

ILLUMINATING RIBBON

BACKGROUND OF THE INVENTION

1. Field of the Invention

The present invention relates to the technical field of an artificial ribbon for decoration use, in particular to an illuminating ribbon.

2. Description of Related Art

In a festival, a banquet or someone's birthday, people always send or exchange gifts to promote atmosphere of festival. In custom, a gift is always put into a package box, which is packaged outside the box with a ribbon to facilitate carrying, while increasing mental expectation of a people receiving the gift before opening the package box.

U.S. Pat. No. 6,681,965 granted to Tran for a "Decorative wire ribbon bow" discloses a ribbon rosette for decoration use to increase pleasantness to the eyes. U.S. Pat. No. 7,416,467 granted to Avdellas for a "Novelty gift package ornament" discloses a rosette device capable of emitting sound. When the rosette device is moved, the sound will be emitted to increase the additive value of the gift.

However, a ribbon having the effect of an illuminating ribbon has not been revealed. Such a creative invention of generating light by the ribbon for packaging a box is capable of enhancing the visual effect. Therefore, it is desirable to improve the conventional ribbons to mitigate and/or obviate the aforementioned problems.

SUMMARY OF THE INVENTION

An object of the present invention is to provide an illuminating ribbon, capable of generating light for the ribbon for packaging a gift so as to increase the additive value of the gift.

Another object of the present invention is to provide an illuminating ribbon, capable of generating light for the ribbon for packaging a gift, in which the light may be illuminated in a pattern, thereby increasing the visual effect.

According to a feature of the invention, an illuminating ribbon is proposed, which comprises a decoration ribbon and a flexible circuit board with light-emitting devices. The decoration ribbon is used to pack a gift to increase a sense of beauty of the gift and has two long sides, in which at least one of the two long sides has a sewing line. The flexible circuit board with light-emitting devices is disposed on the decoration ribbon and fixed to the at least one of the two long sides of the decoration ribbon via the sewing line on the at least one of the two long sides. When packing the gift using the decoration ribbon, the flexible circuit board with light-emitting devices is arranged to be shown in visual. The flexible circuit board with light-emitting devices includes an insulator with flexible flat surface, a first electrical wire and a second electrical wire; N light-emitting devices; and a power device. The first electrical wire and the second electrical wire are embedded in parallel into the insulator with flexible flat surface. The N light-emitting devices are connected to the first electrical wire and the second electrical wire. The power device is connected to the first electrical wire and the second electrical wire to supply power to the N light-emitting devices.

According to another feature of the invention, an illuminating ribbon is proposed, which comprises a decoration ribbon and a flexible circuit board with light-emitting devices. The decoration ribbon has two long sides, in which at least one of the two long sides has a sewing line. The flexible circuit board with light-emitting devices is disposed on the decoration ribbon and fixed to the at least one of the two long sides of the decoration ribbon via the sewing line on the at least one of the two long sides. The flexible circuit board with light-emitting devices includes an insulator with flexible flat surface, a first electrical wire and a second electrical wire; K light-emitting sets; and a power device. The first electrical wire and the second electrical wire are embedded in parallel into the insulator with flexible flat surface. The K light-emitting sets are connected to the first electrical wire and the second electrical wire. The power device is connected to the first electrical wire and the second electrical wire to supply power to the K light-emitting sets.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
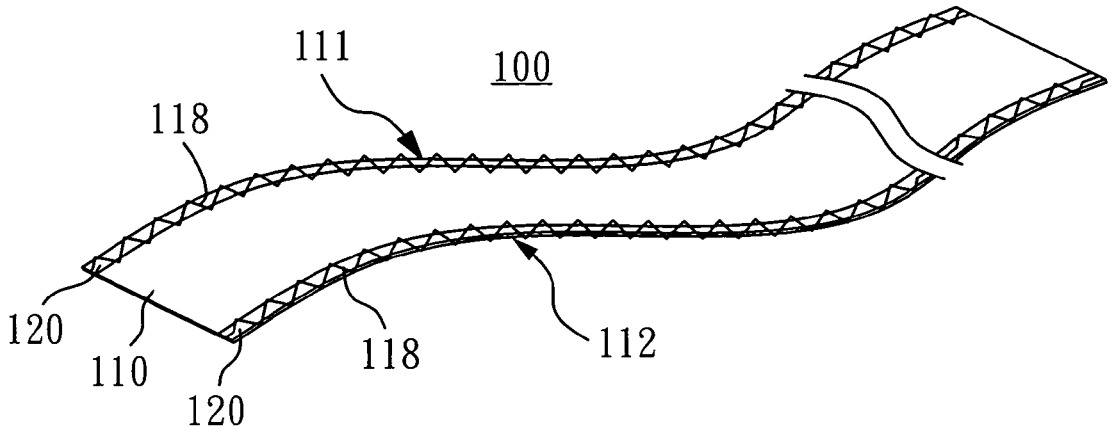
FIG. 1 is a schematic diagram illustrating an illuminating ribbon of the invention.

FIG. 1 is a schematic diagram illustrating an illuminating ribbon 100 of the invention. The illuminating ribbon 100 includes a decoration ribbon 110 and a flexible circuit board with light-emitting devices 120. The decoration ribbon 110 has two long sides 111,112, in which at least one of the two long sides 111,112 has a sewing line 118. In the embodiment, each of the two long sides 111, 112 of the decoration ribbon 110 has a sewing line 118. The sewing line 118 is used for preventing the long sides 111,112 of the decoration ribbon 110 from being loose and for sewing the flexible circuit board with light-emitting devices 120 onto the decoration ribbon 110.

The decoration ribbon 110 is used to pack a gift box (not shown) so as to increase a sense of beauty. The flexible circuit board with light-emitting devices 120 is disposed on the decoration ribbon 110. In the embodiment, two flexible circuit boards with light-emitting devices 120 are respectively disposed on the two long sides 111,112 of the decoration ribbon 110 and are respectively fixed to the two long sides 111,112 of the decoration ribbon 110 via the sewing line 118 respectively on each of the two long sides 111,112. As such, the two flexible circuit boards with light-emitting devices 120 are arranged such that as the decoration ribbon 110 is used to pack the gift box, they are shown visually.

Figure 2:
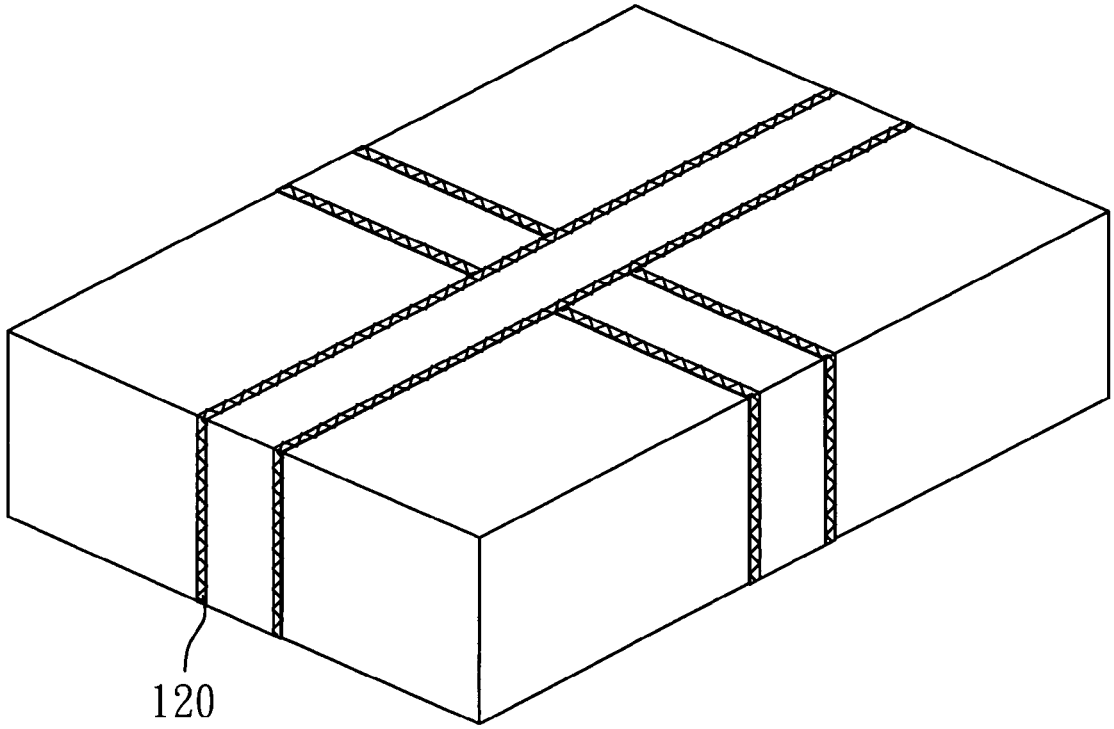
FIG. 2 is a schematic diagram illustrating the packing of a gift box using an illuminating ribbon of the invention.

FIG. 2 is a schematic diagram showing the packing of a gift box using an illuminating ribbon of the invention. In packing, the two flexible circuit boards with light-emitting devices 120 face outwardly such that they are shown visually.

Figure 3:
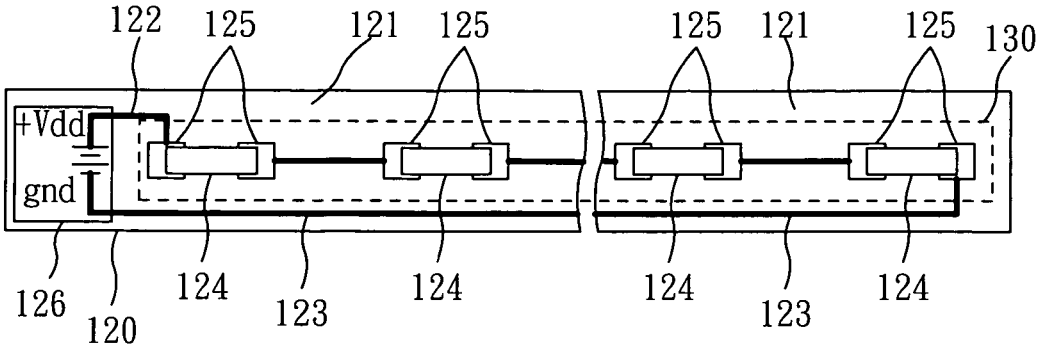
FIG. 3 is a schematic diagram illustrating at least a flexible circuit board with light-emitting devices of a first preferred embodiment of the invention.

FIG. 3 is a schematic diagram showing at least a flexible circuit board with light-emitting devices 120 of a first preferred embodiment of the invention. The at least a flexible circuit board with light-emitting devices 120 includes an insulator with flexible flat surface 121; a first electrical wire 122 and a second electrical wire 123; N light-emitting devices 124; N sets of solder pads 125 and a power device 126 (N is a positive integer greater than 1).

The insulator with flexible flat surface 121 is preferably of polyvinyl chloride (PVC).

The first electrical wire 122 and the second electrical wire 123 are embedded in parallel into the insulator with flexible flat surface 121.

The N light-emitting devices 124 are connected to the first electrical wire 122 and the second electrical wire 123. The N light-emitting devices 124 are SMT (surface-mounted technology) light-emitting diodes.

The power device 126 is connected to the first electrical wire 122 and the second electrical wire 123 to supply power to the N light-emitting devices 124. Preferably, the power device 126 is a DC power device with current-limiting.

The insulator with flexible flat surface 121 further has N sets of solder pad sets 125 thereon and the N light-emitting devices 124 are respectively surface-mounted on the N sets of solder pads 125.

As shown in FIG. 3, the N light-emitting devices 124 and the N sets of solder pads 125 constitute a light-emitting set 130. In the light-emitting set 130, a first solder pad of the first set of solder pads is connected to the first electrical wire 122, a first solder pad of the second set of solder pads is connected to a second solder pad of the first set of solder pads, a first solder pad of the K-th set of solder pads is connected to a second solder pad of the (K−1)-th set of solder pads, and a second solder pad of the N-th set of solder pads is connected to the second electrical wire 123, such that the N light-emitting devices 124 are connected in series.

Figure 4:
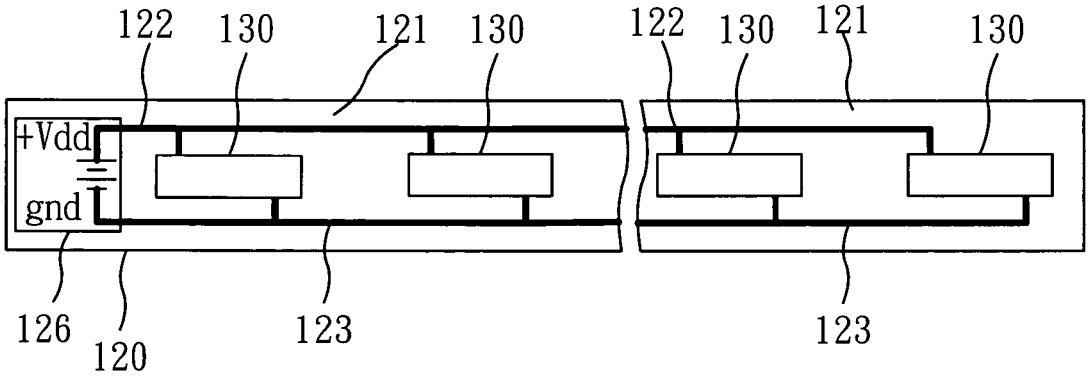
FIG. 4 is a schematic diagram illustrating at least a flexible circuit board with light-emitting devices of a second preferred embodiment of the invention.

FIG. 4 is a schematic diagram illustrating at least a flexible circuit board with light-emitting devices 120 of a second preferred embodiment of the invention. The at least a flexible circuit board with light-emitting devices 120 includes K light-emitting sets 130. Each of the K light-emitting sets 130 has N light-emitting devices 124 and N sets of solder pads 125 thereon. The power source of each light-emitting sets 130 is connected to the first electrical wire 122 and the second electrical wire 123 such that the K light-emitting sets 130 are formed in parallel and the N light-emitting devices 124 in each of the K light-emitting sets 130 are formed in series.

Figure 5:
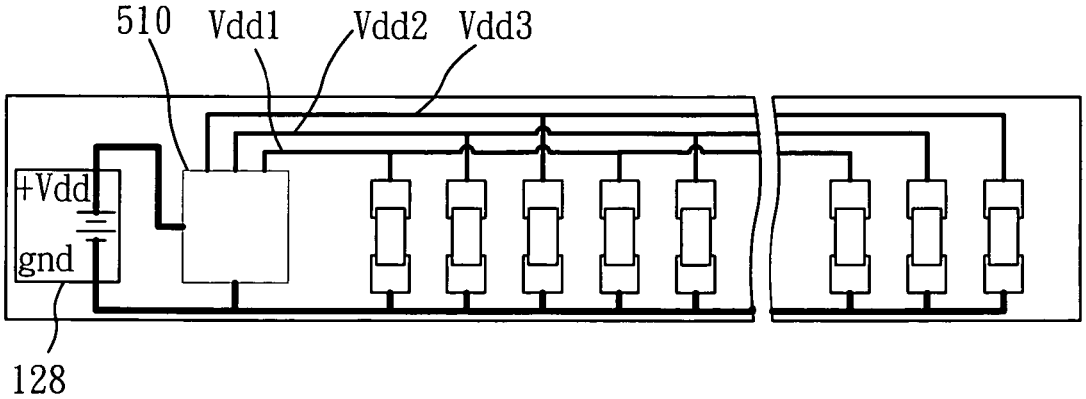
FIG. 5 is a schematic diagram illustrating at least a flexible circuit board with light-emitting devices of a third preferred embodiment of the invention.

FIG. 5 is a schematic diagram illustrating at least a flexible circuit board with light-emitting devices 120 of a third preferred embodiment of the invention. As compared with FIG. 3, this embodiment further provides a controller 510. The controller 510 is connected to a power device 128, being a general power device, to output power signals of Vdd1, Vdd2 and Vdd3 for supplying different light-emitting devices. Through control of the power signals of Vdd1, Vdd2 and Vdd3 via the controller 510, the ribbon for packaging the gift is capable of generating light and the light may be presented in a pattern to increase the visual effect.

In view of the above, the ribbon of providing the effect of an illuminating ribbon of the invention is creative and not found in the prior art. Such a creative invention can allow the ribbon for packing a gift to produce light to increase the visual effect. With the provision of attaching the at least a flexible circuit board with light-emitting devices 120 on the decoration ribbon 110 via the sewing line 118, the ribbon of the invention for packing the gift is able to generate light so as increase the additive value of the gift. Meanwhile, through the power signals of Vdd1, Vdd2 and Vdd3 output by the controller 510 to control the different light-emitting devices 124, the ribbon for packing the gift is capable of generating light and the light may be presented in a pattern to increase the visual effect.

It can be known from the above that as regards the objectives, technical means and effects, the invention is different from the prior art and indeed has practical value. Although the present invention has been explained in relation to its preferred embodiment, it is to be understood that many other possible modifications and variations can be made without departing from the scope of the invention as hereinafter claimed.

What is claimed is:

1. An illuminating ribbon, comprising:

a decoration ribbon, having two long sides, at least one of the two long sides having a sewing line; and at least a flexible circuit board with light-emitting devices, being disposed on the decoration ribbon and fixed to the at least one of the two long sides of the decoration ribbon via the sewing line on the at least one of the two long sides, the at least a flexible circuit board with light-emitting devices including:

an insulator with flexible flat surface;

a first electrical wire and a second electrical wire, embedded in parallel into the insulator with flexible flat surface;

N light-emitting devices, connected to the first electrical wire and the second electrical wire; and a power device, connected to the first electrical wire and the second electrical wire, for supplying power to the N light-emitting devices.

2. The illuminating ribbon as claimed in claim 1, wherein the N light-emitting devices are N light-emitting diodes.

3. The illuminating ribbon as claimed in claim 2, wherein the N light-emitting diodes are SMT (surface-mounted technology) light-emitting diodes.

4. The illuminating ribbon as claimed in claim 3, wherein the insulator with flexible flat surface further has N sets of solder pads thereon and the N light-emitting diodes are respectively surface-mounted on the N sets of solder pads.

5. The illuminating ribbon as claimed in claim 4, wherein a first solder pad of the first set of solder pads is connected to the first electrical wire, a first solder pad of the second set of solder pads is connected to a second solder pad of the first set of solder pads, a first solder pad of K-th set of solder pads is connected to a second solder pad of (K−1)-th set of solder pads, and a second solder pad of N-th set of solder pads is connected to the second electrical wire, such that the N light-emitting diodes are connected in series.

6. The illuminating ribbon as claimed in claim 1, wherein the power device is a DC power device.

7. The illuminating ribbon as claimed in claim 1, wherein the at least a flexible circuit board with light-emitting devices further includes:

a controller, connected to the power device, for controlling conduction of the N light-emitting devices.

8. An illuminating ribbon, comprising:

a decoration ribbon, having two long sides, at least one of the two long sides having a sewing line; and at least a flexible circuit board with light-emitting devices, being disposed on the decoration ribbon and fixed to the at least one of the two long sides of the decoration ribbon via the sewing line on the at least one of the two long sides, the at least a flexible circuit board with light-emitting devices including:

an insulator with flexible flat surface;

a first electrical wire and a second electrical wire, embedded in parallel into the insulator with flexible flat surface;

K light-emitting sets, connected to the first and second electrical wires; and a power device, connected to the first electrical wire and the second electrical wire, for supplying power to the K light-emitting sets.

9. The illuminating ribbon as claimed in claim 8, wherein each light-emitting set has N SMT (surface-mounted technology) light-emitting diodes.

10. The illuminating ribbon as claimed in claim 9, wherein the insulator with flexible flat surface has N×K sets of solder pads thereon, and the N light-emitting diodes of each light-emitting set are respectively surface-mounted on the N sets of solder pads to allow the K light-emitting sets to be formed in parallel and to allow the N light-emitting diodes of each light-emitting set to be formed in series.

* * * * *

UNITED STATES PATENT AND TRADEMARK OFFICE

CERTIFICATE OF CORRECTION

PATENT NO. : 7,967,470 B2
APPLICATION NO. : 12/379016
DATED : June 28, 2011
INVENTOR(S) : Jen-Chi Chang It is certified that error appears in the above-identified patent and that said Letters Patent is hereby corrected as shown below:

Title Page, should read;
Correct line (73) Assignee: Shien[[g]]q Huong Enterprise Co., Ltd.

Signed and Sealed this
Seventeenth Day of April, 2012

David J. Kappos

David J. Kappos
*Director of the United States Patent and Trademark Office*